US005245764A

United States Patent [19]

Sung

[11] Patent Number: 5,245,764

[45] Date of Patent: Sep. 21, 1993

[54] METHOD FOR CONTROLLING A LAUNDRY DRYER

[75] Inventor: Young Ju Sung, Changwon-si, Rep. of Korea

[73] Assignee: GoldStar Co., Ltd., Rep. of Korea

[21] Appl. No.: 977,956

[22] Filed: Nov. 18, 1992

[30] Foreign Application Priority Data

Nov. 18, 1991 [KR] Rep. of Korea ..... 20501

[51] Int. Cl.[5] ..... F26B 19/00

[52] U.S. Cl. ..... 34/48; 34/43

[58] Field of Search ..... 34/48, 54, 55, 43, 44

[56] References Cited

U.S. PATENT DOCUMENTS 4,622,759 11/1986 Abe et al. ..... 34/48 X 4,738,034 4/1988 Muramatsu et al. ..... 34/48 X

*Primary Examiner*—Henry A. Bennet

*Attorney, Agent, or Firm*—Morgan & Finnegan

[57] ABSTRACT

A method for controlling a laundry dryer in accordance with an amount of laundry to be dried, comprising discriminating the amount of blankets contained in a drum and controlling the output of a heater unit, based on the discrimination as to the amount of blankets. The discrimination is based on the room air temperature and the temperature difference between the internal temperature sensed by a drum temperature sensor and the exhaust air temperature sensed by an exhaust air temperature sensor after the dehumidification of air, when a predetermined period has lapsed after the start of initial drying. Three drying steps are carried out under the condition that a maximum temperature has been predetermined, based on the discriminated amount of blankets. As a result, it is possible to reduce the total drying period and to avoid an erroneous determination as to a drying condition of the blankets.

7 Claims, 7 Drawing Sheets

| T3 \ ΔTα Ta | ΔT1 | ΔT2 | — — — — — — | ΔTx |
|---|---|---|---|---|
| T11 | Z11 | Z12 | — — — — — — | Z1x |
| T12 | Z21 | Z22 | — — — — — — | Z2x |
| ⋮ | ⋮ | ⋮ | — — — — — — | ⋮ |
| T1x | Zx1 | Zx2 | — — — — — — | Zxx |
FIG. 12
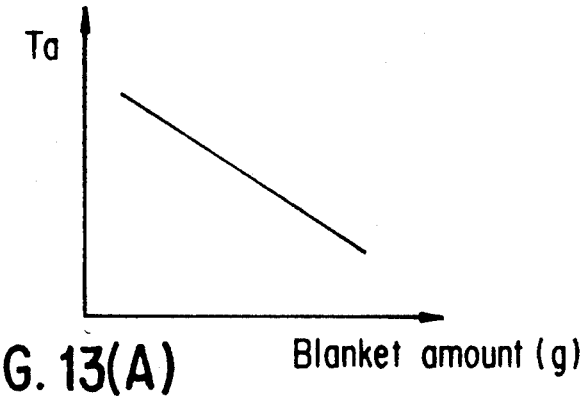
FIG. 13(A)
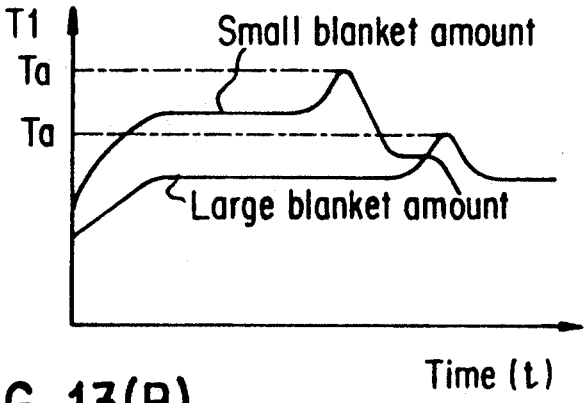
FIG. 13(B)

METHOD FOR CONTROLLING A LAUNDRY DRYER

BACKGROUND OF THE INVENTION

1. Field of the Invention

The present invention relates to an apparatus for drying laundry, and more particularly to a method for controlling such a laundry drying apparatus, capable of controlling the output of a heater unit of the apparatus, based on the amount of laundry to be dried.

2. Description of the Prior Art

Referring to FIG. 1, there is illustrated a conventional apparatus for drying clothing. As shown in FIG. 1, the apparatus comprises a motor 1 disposed at the upper portion of the interior of an outer case 3 and adapted to rotate a drum 5 disposed in the interior of outer case 3 and a heater unit 2 attached to the inner side wall of the outer case and adapted to heat clothing contained in the drum 5. The apparatus also comprises a temperature sensor 6 disposed at the outside of the drum 5 and adapted to sense the internal temperature of the drum 5. At the outer case 3 is disposed a heat exchanging fan 4 which is driven by the driving force of the motor 1 to intake external air into the interior of outer case 3 through an intake opening 10 formed at the outer case 3 and carry out a heat exchange between the air and the high temperature and moist air in the drum 5. At the lower portion of the outer case 3, a dehumidifying passage 9 having a discharge port 11 is provided. Water condensed during the heat exchange is collected at the dehumidifying passage 9 and then discharged through the discharge port 11. Another temperature sensor 7 is disposed in the outer case 3, so as to sense the temperature of an exhaust air, that is, the air completed the heat exchange with the hot and moist air in the drum 5. Within the drum 5, a filter 8 is disposed which serves to filter the air in the drum, so as to separate bits of thread and nap from the air. A door 12 is mounted to the front portion of outer case 3, for giving clothing access to the drum 5.

FIG. 2 is a block diagram of a system for controlling the drying period of the clothing drying apparatus shown in FIG. 1. As shown in FIG. 2, the control system comprises a microcomputer 13 for controlling the operations of the overall system of clothing drying apparatus, depending on the internal temperature of drum 5, the exhaust air temperature and key signals from a key pad 14, a load driving unit 15 including triacs TA1 to TA4 for driving the motor 1 and heater unit 2 under the control of the microcomputer 13, and a display unit 16 for displaying various conditions such as the clothing drying period and etc., under the control of the microcomputer 13. The heater unit 2 comprises three heaters H1 to H3 which are controlled by the triacs TA1 to TA3.

In FIG. 2, the reference character AC denotes an alternating current voltage source.

Now, the operation of the control system for controlling the conventional clothing drying apparatus with the above-mentioned arrangement will be described, in conjunction with FIGS. 3 to 5.

When a wet clothing, for example, a wet blanket is to be dried, the user opens the door 12 and puts the wet blanket into the drum 5. As a blanket key and a drying start key on the key pad 14 are manually pushed, the microcomputer 13 operates to turn on the triac TA4 of the load driving unit 15, thereby causing the motor 1 to be driven. By the driving of motor 1, both the drum 5 and the heat exchanging fan 4 are rotated. On the other hand, the triacs TA1 and TA2 are also turned on by the operation of microcomputer 13, so that the corresponding heater H1 and H2 of the heater unit 2 are actuated. Accordingly, the internal temperature of drum 5 is gradually increased so that the blanket disposed in the drum 5 is gradually dried (a step 1 in FIG. 1).

As air contained in the interior of drum 5 is saturated with a moisture evaporated from the wet blanket, it is changed into a very hot and moist air. This hot and moist air is fed to the heat exchanging fan 4, via the filter 8 mounted to the center portion of the rear portion of drum 5. At the heat exchanging fan 4, the hot and moist air performs a heat exchange with a cold air which is introduced into the interior of outer case 3 through the intake opening 10 by the heat exchange fan 4. Water condensed during the heat exchange is collected at the dehumidifying passage 9 and then discharged out of the dehumidifying passage 9 through the discharge port 11.

By the above-mentioned heat exchange, the dehumidified air is changed into an air which is low in temperature and humidity. The air passes through the dehumidifying passage 9 and is then heated by the heaters H1 and H2. The heated air is then introduced into the drum 5, to dry the blanket disposed in the drum 5.

As shown in FIG. 3, the internal temperature of drum 5 is increased by the operation of heater unit 2, during a predetermined primary drying period t1 after the start of drying. As the evaporation proceeds actively, however, the internal temperature increases no longer and is constantly maintained. When the evaporation is almost completed, the internal temperature of drum 5 increases again. During this primary drying period, the microcomputer 13 determines continuously whether the internal temperature of drum 5 sensed by the temperature sensor 6 has reached a predetermined maximum drying temperature Ta (a step 2 in FIG. 5).

For a maximum drying period of, for example, 5 hours, the microcomputer 13 continues the determination as to whether the sensed internal temperature of drum 5 has reached the predetermined maximum drying temperature Ta (a step 3 in FIG. 5). If the sensed internal temperature of drum 5 has not reached the predetermined maximum drying temperature Ta for the maximum drying period, the microcomputer 13 shut off both the motor 1 and the heater unit 2, thereby causing the drying to cease (a step 4 in FIG. 5). Simultaneously, the microcomputer 13 makes the display unit 16 display an error about the drying.

Where the internal temperature of drum 5 sensed by the temperature sensor 6 has reached the predetermined temperature Ta within the primary drying period t1, the drying rate exceeds 90%. In this case, the microcomputer 13 controls the load driving unit 15, to turn off the heater H2, but to proceed a secondary drying for a secondary drying period t2 (a step 5 in FIG. 5). Such a control of microcomputer 13 is needed for avoiding the blanket in the drum 5 from being maintained at a high temperature for a long time, since the blanket is susceptible to heat.

Thereafter, the microcomputer 13 determines whether the secondary drying period t2 has lapsed (a step 6 in FIG. 5). If the secondary drying period t2 has lapsed, the microcomputer 13 turns off the heater H1 (a step 7 in FIG. 5) and actuates the heat exchange fan 4, so as to proceed a third drying for a third drying period t3 (a step 8 in FIG. 5). After the third drying period t3 has lapsed, the microcomputer 13 shuts off the motor 1 to complete the drying (a step 9 in FIG. 5).

In the above-mentioned conventional clothing drying apparatus, however, there is no consideration about the amount of load, namely, the amount of blankets to be dried, in that the drying operation is continued until the internal temperature of drum sensed by the temperature sensor reaches the predetermined maximum drying temperature. The internal temperature of drum varies depending on the amount of blankets put into the drum, as shown in FIG. 4. Where the amount of blankets is large, the internal temperature of drum may not reach the predetermined maximum drying temperature even after the predetermined maximum period of, for example, 5 hours. In this case, the microcomputer 13 determines such a situation as that the blankets have not been dried yet, ceases the drying and displays an error about it. However, the blankets have already been at a dried condition, even though the internal temperature of drum does not reach the predetermined maximum drying temperature, due to the large amount of blankets in the drum. As a result, the conventional arrangement encounters problems of lengthening the drying period and erroneously determining an actual drying condition of almost 100% as an insufficient drying condition.

SUMMARY OF THE INVENTION

Therefore, an object of the invention is to provide a method for controlling an apparatus for drying laundry, capable of varying a predetermined maximum drying temperature, depending on the amount of laundry to be dried and thus avoiding an erroneous determination as to a drying condition of the clothing.

In accordance with the present invention, this object can be accomplished by providing a method for controlling a laundry dryer including a drum containing blankets to be dried therein and a heater unit, comprising the steps of: sensing an internal temperature of the drum, a temperature of a room air and a temperature of an exhaust air, at an optional time point during a drying operation of the apparatus, said exhaust air occurring after an air contained in the drum is carried out a heat exchange with the room air supplied to the apparatus; calculating a temperature difference between the internal temperature of the drum and the exhaust air temperature; predetermining a maximum drying temperature, based on an amount of the blankets discriminated by the temperature difference and the room air temperature, the maximum drying temperature corresponding to an internal temperature of the drum at which the heater unit is shut off; and controlling the heater unit, based on the predetermined maximum drying temperature.

BRIEF DESCRIPTION OF THE DRAWINGS

Other objects and aspects of the invention will become apparent from the following description of embodiments with reference to the accompanying drawings in which:

FIG. 12 is a table showing the relationship of the predetermined maximum drying temperature with the temperature difference and the room air temperature in the system shown in FIG. 7;

FIGS. 13A and 13B are graphs showing a relationship between the internal temperature of drum and the amount of blankets, wherein FIG. 13A shows a variation in the internal temperature of drum depending on the amount of blankets, while FIG. 13B shows a variation in the internal temperature of drum depending on time.

DETAILED DESCRIPTION OF THE PREFERRED EMBODIMENTS

Figure 6:
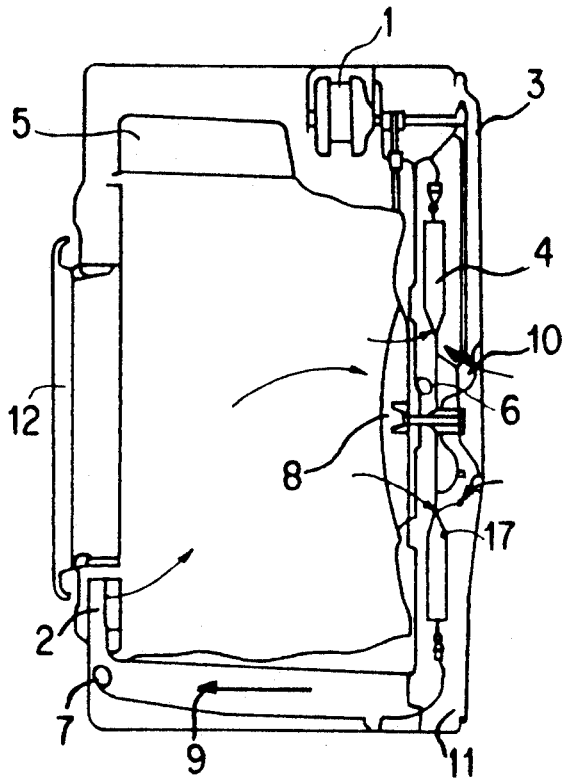
FIG. 6 is a schematic sectional view of a clothing drying apparatus in accordance with the present invention.

Referring to FIG. 6, there is illustrated an apparatus for drying clothing in accordance with the present invention. In FIG. 6, the same reference numerals as those in FIG. 1 denote the same constituting elements.

As shown in FIG. 6, the apparatus of the present invention comprises a motor 1 disposed at the upper portion of the interior of an outer case 3 and adapted to rotate a drum 5 disposed in the interior of outer case 3 and a heater unit 2 attached to the inner side wall of the outer case and adapted to heat clothing contained in the drum 5. The apparatus also comprises a temperature sensor 6 disposed at the outside of the drum 5 and adapted to sense the internal temperature of the drum 5. At the outer case 3 is disposed a heat exchanging fan 4 which is driven by the driving force of the motor 1 to intake external air into the interior of outer case 3 through an intake opening 10 formed at the outer case 3 and carry out a heat exchange between the air and the high temperature and moist air in the drum 5. At the lower portion of the outer case 3, a dehumidifying passage 9 having a discharge port 11 is provided. Water condensed during the heat exchange is collected at the dehumidifying passage 9 and then discharged through the discharge port 11. Another temperature sensor 7 is disposed in the outer case 3, so as to sense the temperature of an exhaust air, that is, the air completed the heat exchange with the hot and moist air in the drum 5.

Another temperature sensor 17 is also disposed at the heat exchange fan 4, so as to sense the temperature of external air introduced through the heat exchange fan 4, that is, the room temperature. Within the drum 5, a filter 8 is disposed which serves to filter the air in the drum, so as to separate bits of thread and nap from the air. A door 12 is mounted to the front portion of outer case 3, for giving clothing access to the drum 5.

Figure 1:
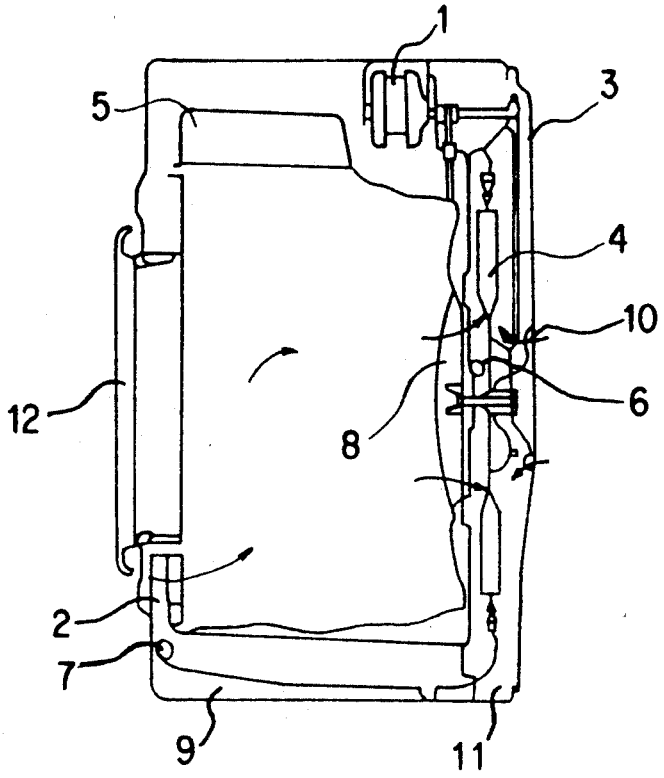
FIG. 1 is a schematic sectional view of a conventional clothing drying apparatus.
Figure 2:
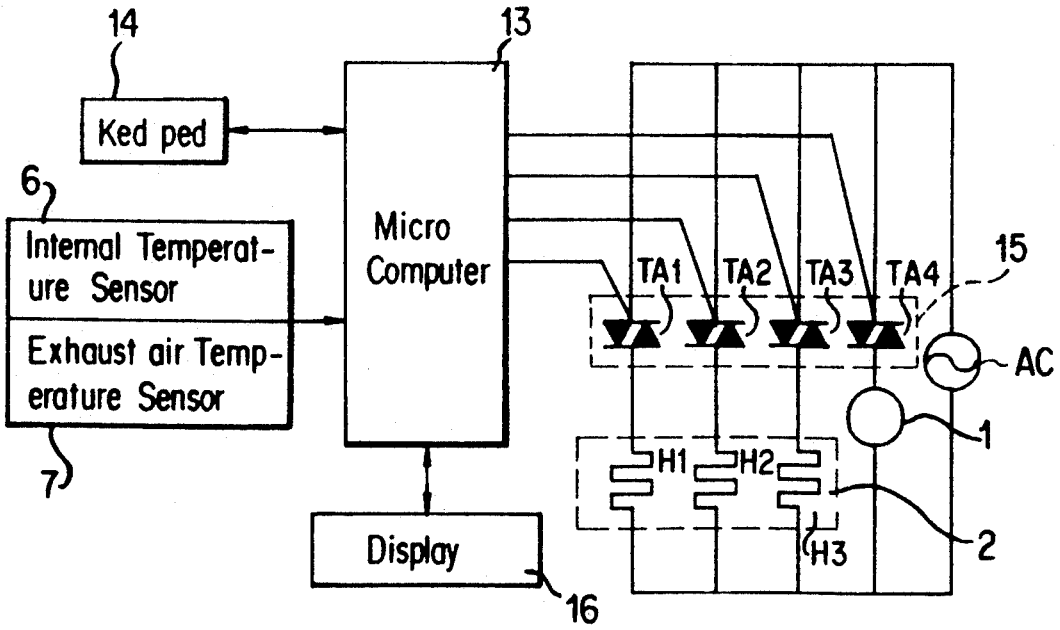
FIG. 2 is a block diagram of a control system for the conventional clothing drying apparatus shown in FIG. 1.
Figure 3:
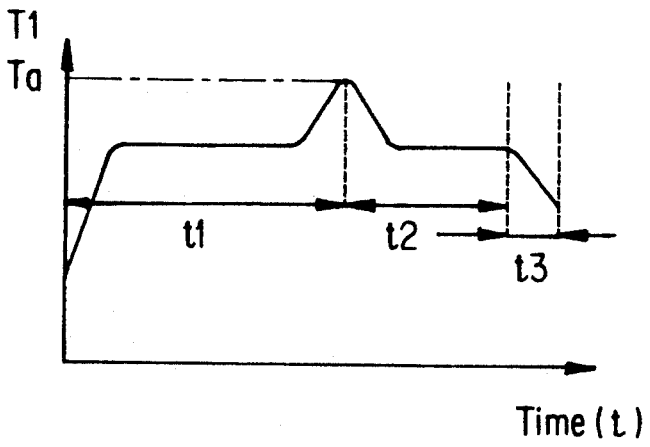
FIG. 3 is a graph showing a variation in internal temperature of a drum depending on a lapse of time in the system shown in FIG. 2.
Figure 4:
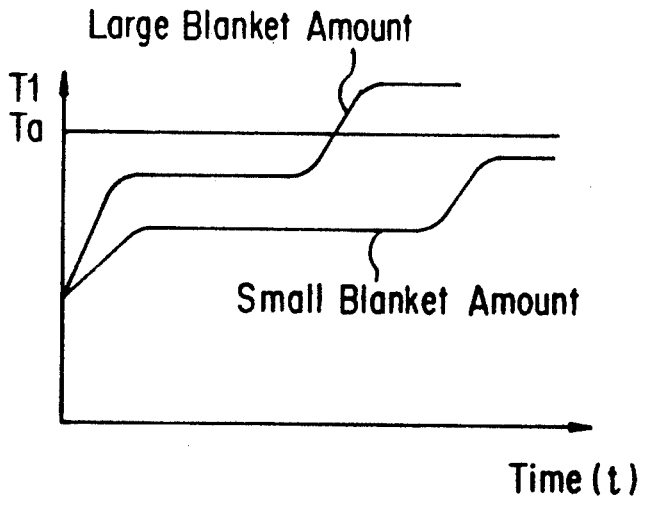
FIG. 4 is a graph showing a variation in internal temperature of a drum depending on the amount of blankets in the system shown in FIG. 2.
Figure 5:
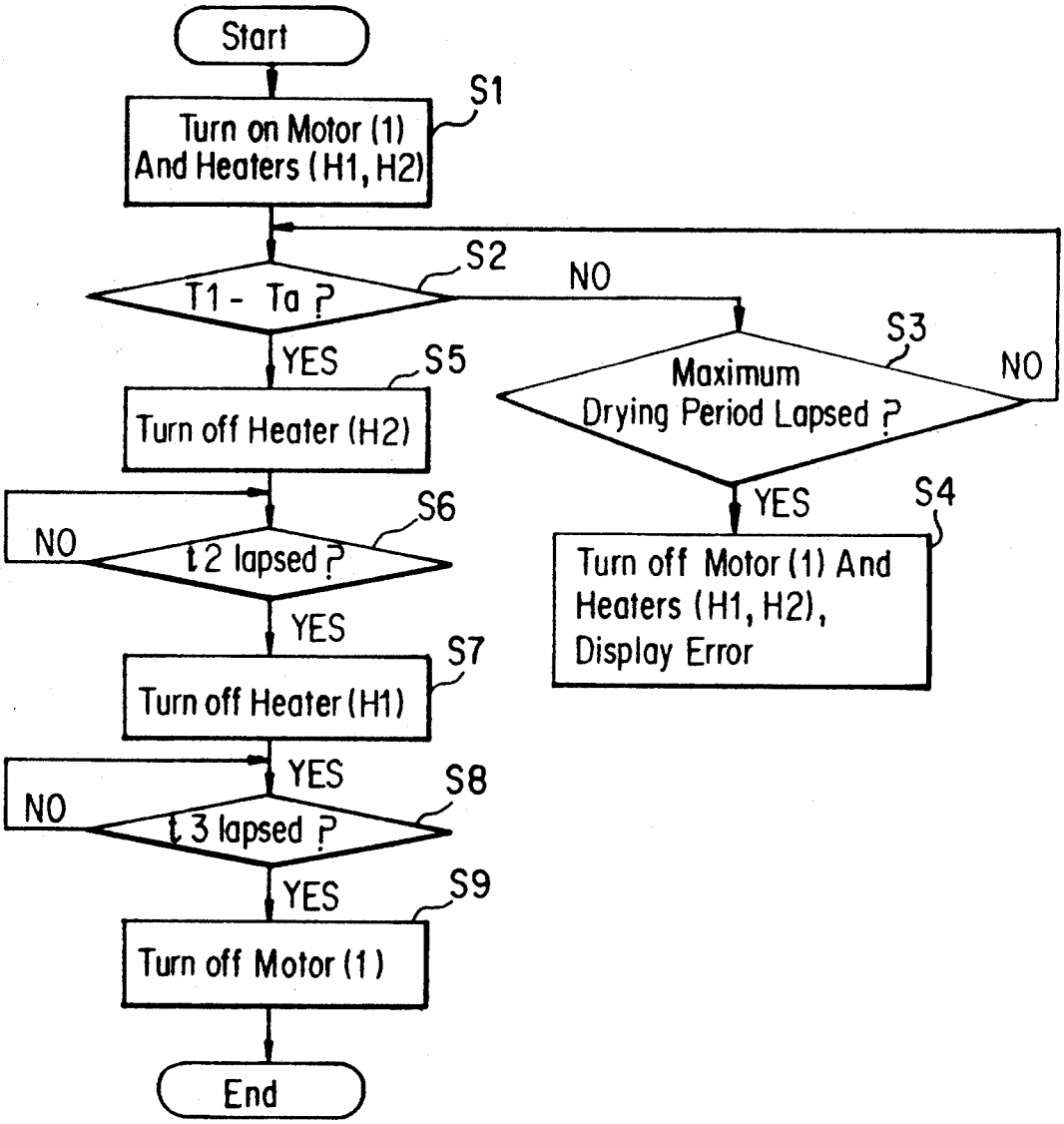
FIG. 5 is a flow chart showing the operation of the system shown in FIG. 2.
Figure 7:
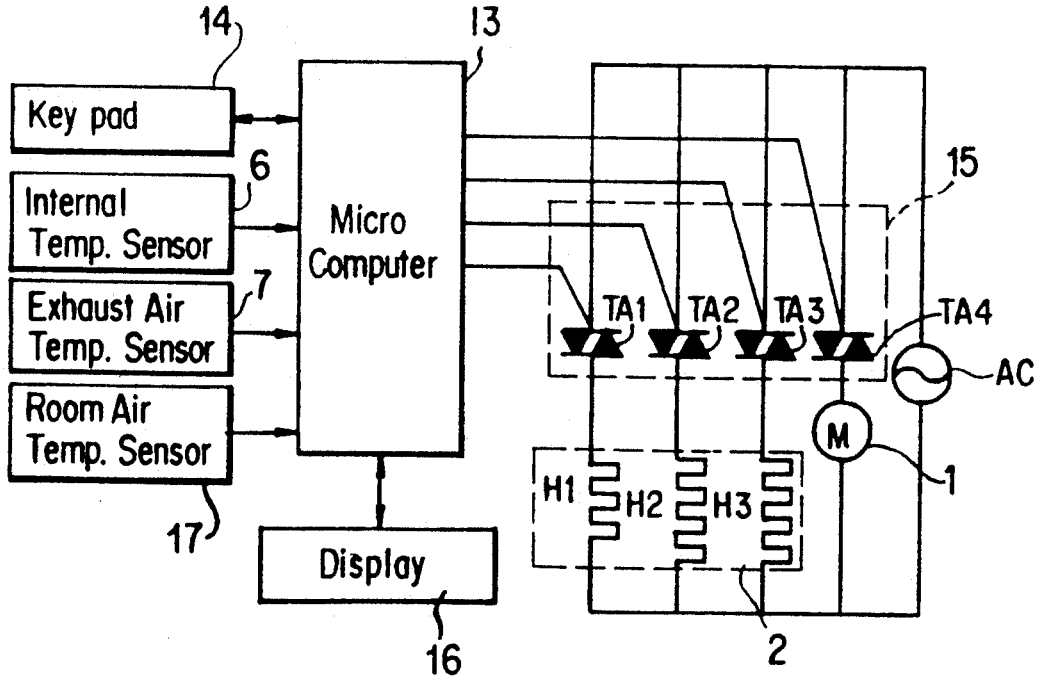
FIG. 7 is a block diagram of a control system for the clothing drying apparatus shown in FIG. 6.

FIG. 7 is a block diagram of a system for controlling the drying period of the clothing drying apparatus shown in FIG. 1. As shown in FIG. 7, the control system comprises a microcomputer 13 for controlling the operations of the overall system of clothing drying apparatus, depending on the internal temperature of drum 5 sensed by the temperature sensor 6, the exhaust air temperature sensed by the temperature sensor 7, the room temperature sensed by the temperature sensor 17 and key signals from a key pad 14, a load driving unit 15 including triacs TA1 to TA4 for driving the motor 1 and heater unit 2 under the control of the microcomputer 13, and a display unit 16 for displaying various conditions such as a clothing drying period and etc., under the control of the microcomputer 13. The heater unit 2 comprises three heaters H1 to H3 which are controlled by the triacs TA1 to TA3.

In FIG. 7, the reference character AC denotes an alternating current voltage source.

Now, the operation of the control system for controlling the clothing drying apparatus will be described, in conjunction with FIGS. 6 to 14.

When wet clothing, for example, wet blankets are to be dried, the user opens the door 12 and puts the wet blankets into the drum 5. As a blanket key and a drying start key on the key pad 14 are manually pushed, the microcomputer 13 operates to turn on the triac TA4 of the load driving unit 15, thereby causing the motor 1 to be driven. By the driving of motor 1, both the drum 5 and the heat exchanging fan 4 are rotated. The microcomputer 13 also turns on the triacs TA1 and TA2 of the load driving unit 15 so that the corresponding heaters H1 and H2 of the heater unit 2 are actuated. Accordingly, a primary drying is carried out (a step 11 in FIG. 14). In the illustrated embodiment, only two heaters H1 and H2 are used, for carrying out the drying of blankets.

The air in the drum 5 is heated to a high temperature by the heaters H1 and H2 and thus serves to evaporate moisture contained in the wet blankets. By this evaporation, the air in the drum 5 is changed into a very hot and moist air. This hot and moist air is fed to the heat exchanging fan 4, via the filter 8 mounted to the center portion of the rear portion of drum 5. At the heat exchanging fan 4, the hot and moist air performs a heat exchange with a cold air which is introduced from the external, namely, the room into the interior of outer case 3 through the intake opening 10 by the heat exchange fan 4. Water condensed during the heat exchange is collected at the dehumidifying passage 9 and then discharged out of the dehumidifying passage 9 through the discharge port 11. By the heat exchange, the dehumidified air is changed into an air which is low in temperature and humidity. The air passes through the dehumidifying passage 9 and is then heated by the heaters H1 and H2. The heated air is introduced into the drum 5, to dry the blankets disposed in the drum 5. During the primary drying period as mentioned above, the microcomputer 13 determines whether a predetermined period ta has lapsed (a step 12 in FIG. 14).

Figure 14:
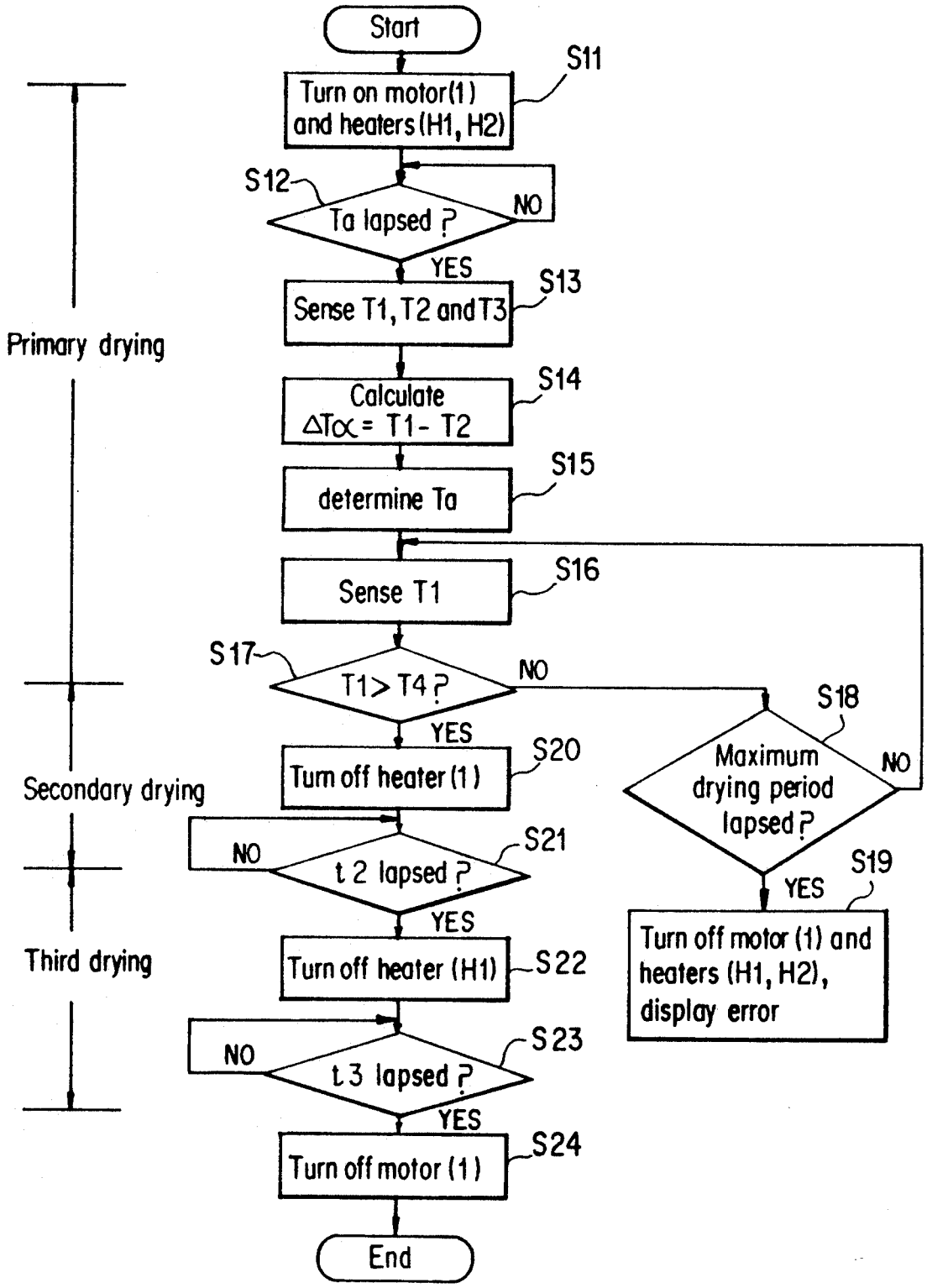
FIG. 14 is a flow chart showing the operation of the system shown in FIG. 7.

If the predetermined period ta has lapsed, the microcomputer 13 receives a signal from the temperature sensor 6 indicative of the internal temperature T1 of drum 5, a signal from the temperature sensor 7 indicative of the exhaust air temperature T2 after the dehumidification and cooling and a signal from the temperature sensor 17 indicative of the temperature T3 of the room air introduced by the heat exchanging fan 4 and adapted to cool the air in drum 5 (a step 13 in FIG. 14).

Thereafter, the microcomputer 13 calculates the temperature difference $T\alpha$ between the sensed internal temperature T1 of drum 5 and the sensed exhaust air temperature T2 (a step 14 in FIG. 14). The microcomputer 13 then determines a predetermined maximum drying temperature Ta according to an operation based on the calculated temperature difference $T\alpha$ and the sensed room air temperature T3 (a step 15 in FIG. 14).

Figure 8:
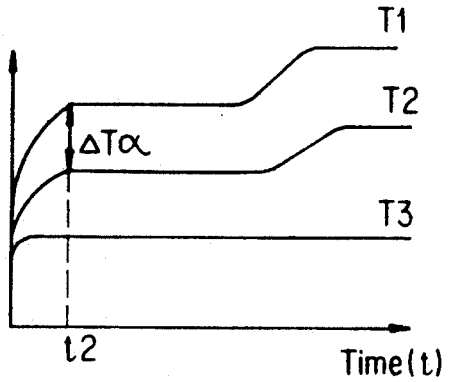
FIG. 8 is a graph showing respective variations in outputs of various temperature sensors depending on a lapse of time in the system shown in FIG. 7.
Figure 9:
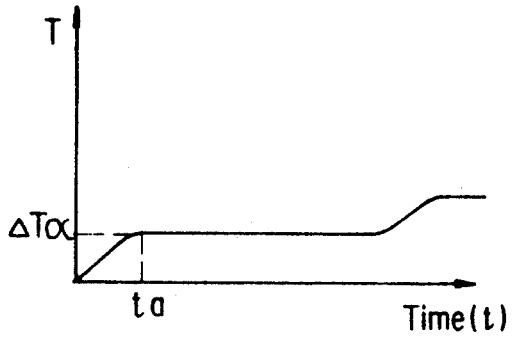
FIG. 9 is a graph showing a variation in the temperature difference between the internal temperature of drum and the exhaust air temperature in the system shown in FIG. 7.
Figure 10:
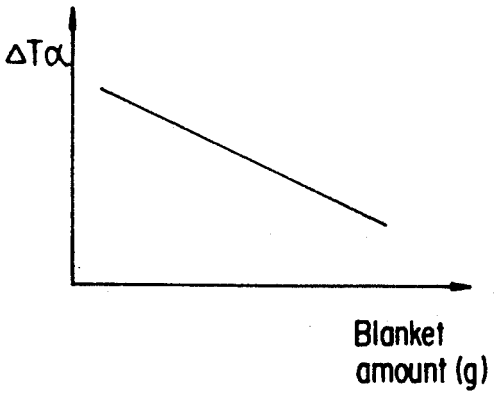
FIG. 10 is a graph showing a variation in the temperature difference between the internal temperature of drum and the exhaust air temperature, depending on the amount of blankets, in the system shown in FIG. 7.
Figure 11:
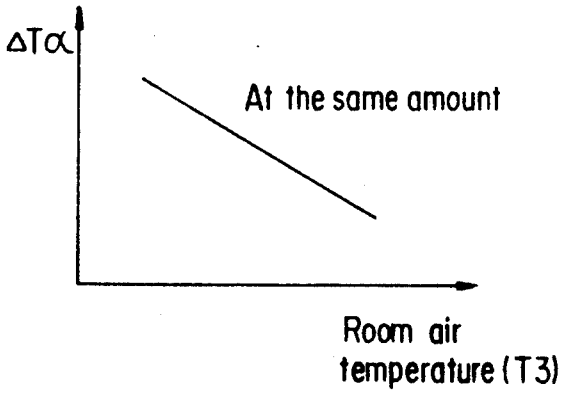
FIG. 11 is a graph showing a variation in the temperature difference between the internal temperature of drum and the exhaust air temperature, depending on the room air temperature, in the system shown in FIG. 7.

After the predetermined period ta has lapsed during the primary drying, the evaporation proceeds actively. However, the internal temperature T1 of drum 5 and the exhaust air temperature T2 increase no longer and are constantly maintained, as shown in FIG. 8. This is because once the internal temperature in the drum 5 reaches a certain temperature, the thermal energy from the heaters is totally consumed as evaporation heat for evaporating the moisture in the drum 5. As a result, the temperature difference $T\alpha$ between the sensed internal temperature T1 of drum 5 and the sensed exhaust air temperature T2 is also constantly maintained after the predetermined period ta has lapsed, as shown in FIG. 9. The temperature difference $T\alpha$ at the time point at which the predetermined period ta has lapsed is inversely proportional to the amount of blankets to be dried in the drum 5, as shown in FIG. 10. That is, the temperature difference $T\alpha$ is decreased at an increase in the amount of blankets.

The temperature difference $T\alpha$ is also varied, depending upon the room air temperature T3. For example, the temperature difference $T\alpha$ at the room air temperature of 0° C. is larger than the temperature difference $T\alpha$ at the room air temperature of 40° C. This is because the latter room air temperature is relatively high and thus the temperature of the exhaust air completed the dehumidification and cooling more approaches the internal temperature of drum 5. Accordingly, at the same temperature difference $T\alpha$ of, for example 10° C., the amount of blankets contained in the drum 5 at the higher room air temperature T3 of, for example, 15° C. is determined as being larger than that at the lower room air temperature T3 of, for example, 25° C., in accordance with the present invention.

In this manner, the microcomputer 13 discriminates the amount of blankets based on the calculated temperature difference $T\alpha$ and the room air temperature T3 sensed by the temperature sensor 17 after the predetermined period ta has lapsed and determines the predetermined maximum drying temperature Ta based on the discriminated amount of blankets.

FIG. 12 is a table showing the relationship of the predetermined maximum drying temperature with the temperature difference $T\alpha$ and the room air temperature T3. In the table, values of the room air temperature T3 have a relationship of $T11>T12>T13 \ldots >Tx$. Values of the temperature difference $T\alpha$ have a relationship of $T1>T2>T3 \ldots >Tx$. On the other hand, values of the predetermined maximum drying temperature Ta have a relationship of $Z11>Z12>Z13 \ldots >Z1x>Z21>Z22 \ldots >Zxx$.

For example, where the room air temperature T3 is constant at T11, the temperature difference Tα may be one of T1 to Tx, depending on the amount of blankets. Herein, the temperature difference Tα is inversely proportional to the amount of blankets, as mentioned above. Accordingly, the amount of blankets can be properly discriminated by the room air temperature T3 and the temperature difference Tα. On the other hand, when the temperature difference Tα is at the maximum value, namely, T1, the predetermined maximum drying temperature Ta is set to the maximum value, namely, Z11. This is because the temperature difference Tα is proportional to the predetermined maximum drying temperature Ta. Consequently, the predetermined maximum drying temperature Ta corresponding to the internal temperature of drum at which the heaters H1 and H2 of heater unit 2 should be shut off is inversely proportional to the discriminated amount of blankets, as shown in FIG. 13A.

Thus, the larger the amount of blankets, the lower the predetermined maximum drying temperature Ta. Since the internal temperature of drum is slowly increased at the large amount of blankets, it may not reach the predetermined maximum drying temperature Ta set to a certain temperature (it is higher than that of the present invention) without taking into consideration the large amount of blankets, until the maximum drying period lapses, even when the drying of blankets have been actually completed. In this case, the microcomputer 13 erroneously determines such an actual drying condition of almost 100% as an insufficient drying condition. In accordance with the present invention, however, such a problem does not occur, in that the predetermined maximum drying temperature Ta is set, taking into consideration the amount of blankets.

Thereafter, the microcomputer 13 receives continuously signals from the temperature sensor 6 indicative of the internal temperature T1 of drum 5 and determines whether the sensed internal temperature T1 has reached the predetermined maximum drying temperature Ta within the maximum drying period of, for example, 5 hours (steps 17 and 18 in FIG. 14).

If the sensed internal temperature T1 has not reached the predetermined maximum drying temperature Ta for the maximum drying period, the microcomputer 13 shut off both the motor 1 and the heater unit 2 to cease the drying and makes the display unit 16 display an error about the drying (a step 19 in FIG. 14).

Where the internal temperature T1 sensed by the temperature sensor 6 has reached the predetermined drying temperature Ta within the primary drying period t1, the drying rate exceeds 90%. In this case, the microcomputer 13 controls the load driving unit 15, to turn off the heater H2 (a step 20 in FIG. 14), but to proceed a secondary drying for a secondary drying period t2 (a step 21 in FIG. 14). If the secondary drying period t2 has lapsed, the microcomputer 13 turns off the heater H1 (a step 22 in FIG. 14) and performs a third drying for a third drying period t3 (a step 23 in FIG. 14). After completing the third drying, the microcomputer 13 shuts off the motor 1 to complete the overall drying (a step 24 in FIG. 14).

The secondary and third drying steps are finish drying steps at which the drying of blankets is more assuredly achieved under the condition that the output of heater unit is decreased and for an optional period experimentally given. If necessary, the drying period at these steps may be varied.

As apparent from the above description, the present invention provides a method for controlling a clothing drying apparatus wherein the amount of blankets to be dried is discriminated, based on the room air temperature and the temperature difference between the internal temperature of drum and the exhaust air temperature after the cooling and dehumidification, so that a predetermined maximum drying temperature corresponding to the internal temperature of drum at which the heater unit should be shut off is determined, based on the discrimination as to the amount of blankets. Where the amount of blankets is large, accordingly, the drying period taken until the internal temperature of drum reaches the predetermined maximum drying temperature is reduced, since the predetermined maximum drying temperature is set to a lower temperature, as compared with the conventional case. As a result, it is possible to reduce the total drying period and to avoid an erroneous determination as to a drying condition of the blankets.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A method for controlling a laundry dryer in accordance with an amount of laundry to be dried, comprising the steps of:

sensing internal temperature of a drum, temperature of a room air and a temperature of an exhaust air at a predetermined time during a drying operation, said exhaust air having been cooled down by a heat exchange between air inside the drum and air inside a room;

calculating a temperature difference between internal temperature and the exhaust air temperature;

determining a maximum drying temperature in accordance with the amount of laundry from a relation between the temperature difference and the temperature of the room air, the maximum drying temperature corresponding to an internal temperature in which a heater unit of the laundry dryer is shut off; and controlling the heater unit in accordance with the determined maximum drying temperature.

2. A method as claimed in claim 1, wherein the amount of laundry is perceived higher as the temperature difference is calculated lower.

3. A method as claimed in claim 1, wherein the maximum drying temperature is determined higher as the amount of laundry is perceived lower.

4. A method as claimed in claim 1, wherein the maximum drying temperature is determined higher as the temperature of the room air is sensed higher.

5. A method as claimed in claim 1, further comprising the step of drying the laundry with a decreased power for a predetermined time after the internal temperature of the drum has come to the determined maximum drying temperature to achieve a thorough drying.

6. A method as claimed in claim 1, further comprising the step of interrupting drying operation when the internal temperature of the drum has not yet come to the determined maximum drying temperature until a predetermined maximum drying time.

7. A method in accordance with claim 1, wherein the predetermined time is a time point that the temperature difference between the internal temperature of the drum and temperature of the exhaust air is constant.

* * * * *